US008621995B2

(12) United States Patent
Claes et al.

(10) Patent No.: US 8,621,995 B2
(45) Date of Patent: Jan. 7, 2014

(54) SLEEVES AND SLEEVE SEGMENTS FOR FLEXOGRAPHY

(75) Inventors: Jan Claes, Mortsel (BE); Luc Vanmaele, Lochristi (BE)

(73) Assignee: Agfa Graphics NV, Mortsel (BE)

( * ) Notice: Subject to any disclaimer, the term of this patent is extended or adjusted under 35 U.S.C. 154(b) by 263 days.

(21) Appl. No.: 13/128,882

(22) PCT Filed: Nov. 24, 2009

(86) PCT No.: PCT/EP2009/065714

§ 371 (c)(1), (2), (4) Date: May 12, 2011

(87) PCT Pub. No.: WO2010/060897

PCT Pub. Date: Jun. 3, 2010

(65) Prior Publication Data

US 2011/0209635 A1 Sep. 1, 2011

Related U.S. Application Data

(60) Provisional application No. 61/118,442, filed on Nov. 27, 2008.

(30) Foreign Application Priority Data

Nov. 26, 2008 (EP) ..... 08169949

(51) Int. Cl.

| | |
|---|---|
| ***B41F 27/12*** | (2006.01) |
| ***B41F 27/10*** | (2006.01) |
| ***B41N 1/12*** | (2006.01) |
| ***B41N 1/22*** | (2006.01) |

(52) U.S. Cl.
USPC ..... 101/375; 101/379; 101/481

(58) Field of Classification Search
CPC ..... B41F 27/105; B41F 27/10; B41F 27/12; B41N 1/12; B41N 1/22
USPC ..... 101/375, 376, 481, 379
See application file for complete search history.

(56) References Cited

U.S. PATENT DOCUMENTS

| | | | | |
|---|---|---|---|---|
| 4,911,073 | A * | 3/1990 | Sillars | 101/181 |
| 5,256,459 | A | 10/1993 | Carlson | |
| 5,706,731 | A | 1/1998 | Francille et al. | |
| 5,819,657 | A | 10/1998 | Rossini | |
| 5,974,972 | A | 11/1999 | Van Denend et al. | |

(Continued)

FOREIGN PATENT DOCUMENTS

| | | |
|---|---|---|
| EP | 0 510 744 A1 | 10/1992 |
| EP | 1 164 011 A2 | 12/2001 |

(Continued)

OTHER PUBLICATIONS

Official Communication issued in International Patent Application No. PCT/EP2009/065714, mailed on Mar. 15, 2010.

*Primary Examiner* — Daniel J Colilla
*Assistant Examiner* — Leo T Hinze
(74) *Attorney, Agent, or Firm* — Keating & Bennett, LLP

(57) ABSTRACT

A sleeve segment for flexography has the shape of a sleeve with a first circular side containing a female registration element and a second circular side containing a male registration element. Also a method for manufacturing a flexographic sleeve segment, segmented sleeves and methods of flexographic printing.

16 Claims, 3 Drawing Sheets

(56) References Cited

U.S. PATENT DOCUMENTS

| | | | | |
|---|---|---|---|---|
| 6,467,409 | B2 * | 10/2002 | Busshoff | 101/375 |
| 6,521,390 | B1 | 2/2003 | Leinenbach et al. | |
| 6,691,614 | B2 * | 2/2004 | Bell et al. | 101/376 |
| 6,806,018 | B2 | 10/2004 | Kanga et al. | |
| 6,820,529 | B2 * | 11/2004 | Elia et al. | 83/659 |
| 7,107,907 | B2 | 9/2006 | Vrotacoe | |
| 7,171,901 | B2 * | 2/2007 | Salvestro | 101/401.1 |
| 7,226,709 | B1 | 6/2007 | Kidnie et al. | |
| 7,682,775 | B2 * | 3/2010 | Rapp et al. | 430/302 |
| 8,096,239 | B2 * | 1/2012 | Gelbart | 101/375 |
| 2004/0131778 | A1 | 7/2004 | Verhoest et al. | |
| 2004/0259022 | A1 | 12/2004 | Hiller et al. | |
| 2006/0055761 | A1 | 3/2006 | Daems et al. | |
| 2008/0105149 | A1 | 5/2008 | Rogge et al. | |
| 2009/0025592 | A1 * | 1/2009 | Gelbart | 101/453 |

FOREIGN PATENT DOCUMENTS

| | | | |
|---|---|---|---|
| EP | 1 428 666 | A1 | 6/2004 |
| EP | 1 594 005 | A2 | 11/2005 |
| WO | 2009/014619 | A1 | 1/2009 |

* cited by examiner

SLEEVES AND SLEEVE SEGMENTS FOR FLEXOGRAPHY

CROSS-REFERENCE TO RELATED APPLICATIONS

This application is a 371 National Stage Application of PCT/EP2009/065714, filed Nov. 24, 2009. This application claims the benefit of U.S. Provisional Application No. 61/118,442, filed Nov. 27, 2008, which is incorporated by reference herein in its entirety. In addition, this application claims the benefit of European Application No. 08169949.8, filed Nov. 26, 2008, which is also incorporated by reference herein in its entirety.

BACKGROUND OF THE INVENTION

1. Field of the Invention

The present invention relates to sleeves and sleeve segments, methods for manufacturing them and their use in methods of flexographic printing.

2. Description of the Related Art

Flexography is commonly used for high-volume runs of printing on a variety of supports such as paper, paperboard stock, corrugated board, films, foils and laminates. Packaging foils and grocery bags are prominent examples.

Today flexographic printing forms are made by both analogue imaging techniques such as a UV exposure through a film mask, e.g. EP 1594005 (DUPONT), and digital imaging techniques which include:

- direct laser engraving on flexographic printing form precursors, e.g. US 2004/0259022 (BASF);
- UV exposure through a LAMS mask, e.g. U.S. Pat. No. 6,521,390 (BASF) and U.S. Pat. No. 7,226,709 (KODAK), wherein LAMS means Laser Ablative Mask System;
- Mask-less direct UV or violet exposure by laser or LED, e.g. U.S. Pat. No. 6,806,018 (MACDERMID); and
- Inkjet printing e.g. EP 1428666 A (AGFA), US 2004/0131778 A (AGFA) and US 2006/0055761 (AGFA).

Flexography is a "kiss impression" printing technology, i.e. the least possible squeeze between printing form and substrate. Two main types of flexographic printing forms can be distinguished: a sheet form and a cylindrical form. The cylindrical form or "sleeve" provides an improved lower change-over-time on press, better registration efficiency and is also well-suited for mounting on laser exposure equipment using a rotatable drum.

Flexographic printing sleeves are made by applying an elastomeric layer onto a plastic, a polymer composite or a metallic cylinder, or by winding a rubber ribbon around a plastic or metallic cylinder followed by a vulcanizing, grinding and polishing step. The forms preferable are seamless forms. As an alternative the elastomeric layer may be first applied on a flat support, which is then bent onto the carrier and bonded (see NYLOFLEX® Infinity Technology from BASF).

Flexographic printing sleeves can be used for flexographic printing of continuous designs such as in wallpaper, decoration, gift wrapping paper and packaging; as well as for flexographic printing of non-continuous designs such as labels.

Flexographic printing sleeves are frequently stored for future re-use. Combinations of different sleeves can be made on the same printing roll, including new flexographic printing sleeves and used flexographic printing sleeves.

A flexographic printing sleeve is usually mounted on a roll core by registering a female registration element on a radially projecting pin of the roll core. EP 510744 A (MILLER GRAPHICS) shows in FIG. 1 a roll core having a plurality of radially projecting pins on a regular distance which allows registering four sleeves on the roll core. As a drawback, the regular distance between the radially projecting pins result in a loss of printing surface between two sleeves and/or a limited set of fixed sizes for the sleeves depending on the distance between the radially projecting pins.

U.S. Pat. No. 7,107,907 (GOSS) discloses in FIG. 3 a rubber blanket cylinder (10) having air holes or air jets (14) and an air supply with a through-flow limiter to alter the air flow according to the axial position of three sleeve-shaped rubber blankets (12, 212, 312). The method of axially positioning or displacing rubber blanket sleeves on the cylinder does not disclose any means for registering the sleeve-shaped rubber blankets with respect to each other.

U.S. Pat. No. 5,974,972 discloses a printing carrier sleeve for mounting printing plates thereon, formed by cutting a sheet of flexible plastic material having opposite edges into a substantially rectangular shape of desired dimensions such that opposite edges are cut-away to provide complementary tabs and openings that interlock with each other, adhering printing plates on the sheet when the sheet is in a substantially flat condition, securing opposite edges of the sheet together in abutting relation so as to prevent air from passing between the opposite edges, and thereby forming the printing carrier sleeve in a cylindrical configuration, by placing a strip of tape on a forming cylinder, securing one edge of the rectangular sheet on the strip of tape on the cylinder, and wrapping the opposite edge of the sheet around the cylinder into abutting relation with the one edge to provide the interlocking arrangement.

A need exists to be able to register sleeves of different width in an easy manner on a roll core of a flexographic printing press without any costly adaptation of the printing press and avoiding any reduction of the total printing surface.

SUMMARY OF THE INVENTION

A surprisingly simple way was found to solve the above cited problems by forming a segmented sleeve consisting of sleeve segments having matching female and male registration elements. Use of female and male registration elements on sleeves was made for mounting them in register on a roll core.

In order to overcome the problems described above, preferred embodiments of the present invention provide a sleeve segment as defined below.

A preferred embodiment of the present invention provides a segmented sleeve containing the above sleeve segment.

A preferred embodiment of the present invention provides a method for manufacturing the above sleeve segment.

Further objects of the invention will become apparent from the description hereinafter.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Definitions

The term "sleeve", as used in the preferred embodiments of the present invention, means a basic sleeve or a flexographic printing sleeve.

The term "basic sleeve", as used in the preferred embodiments of the present invention, means a sleeve without elastomeric layers on its outer surface.

The term "flexographic printing sleeve", as used in the preferred embodiments of the present invention, means a basic sleeve having one or more elastomeric layers on its outer surface.

The term "sleeve segment", as used in the preferred embodiments of the present invention, means a segment of a basic sleeve or a segment of a flexographic printing sleeve.

Sleeve Segments

Figure 1:
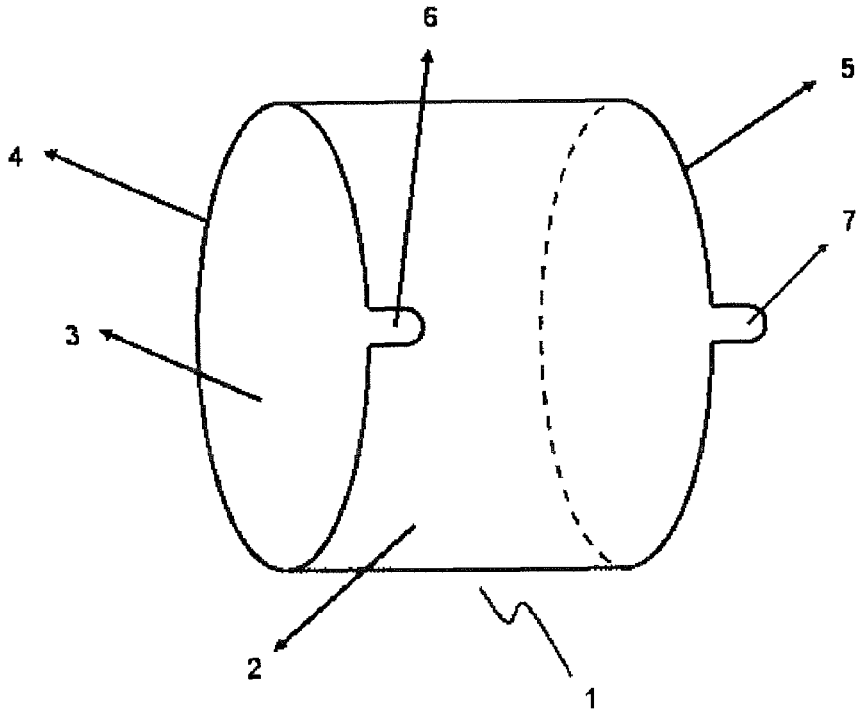
FIG. 1 shows a perspective view of a sleeve segment (1) having a female registration element (6) and a male registration element (7).
Figure 5:
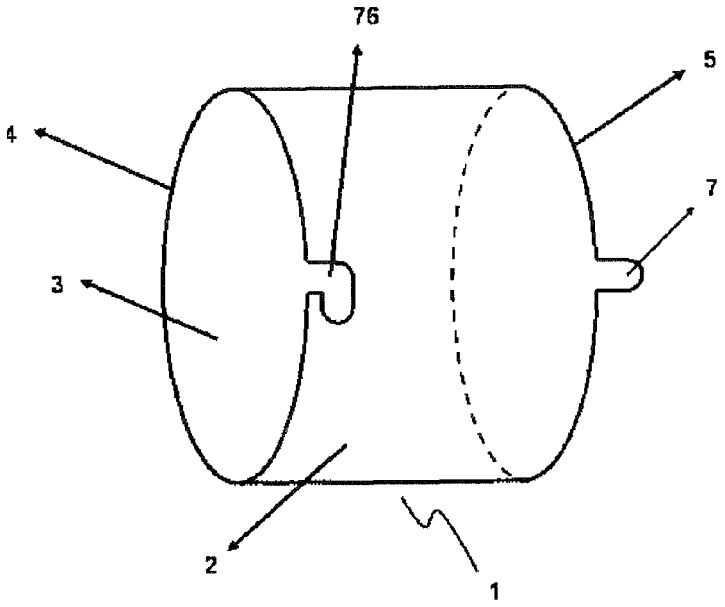
FIG. 5 shows a perspective view of a sleeve segment (1) having an L-shaped female registration element (76) and a male registration element (7) having different shapes, i.e. the female.
Figure 6:
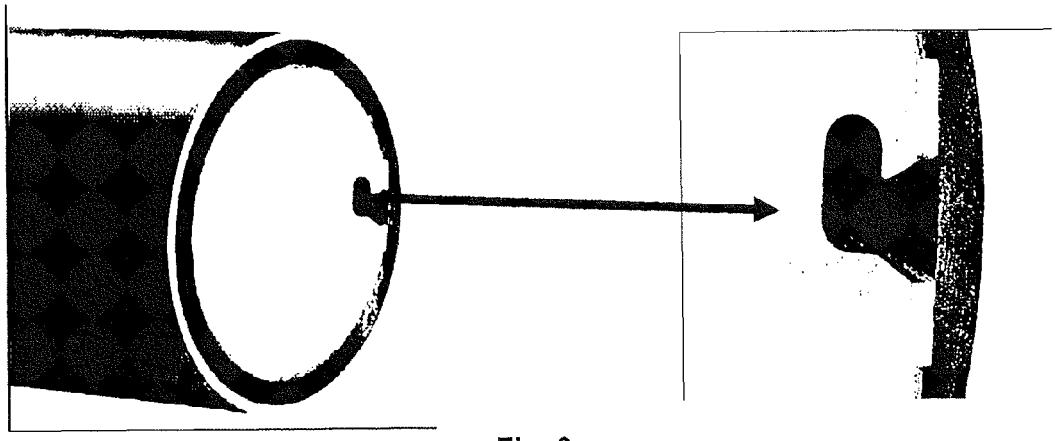
FIG. 6 is a photograph showing a practical implementation of the sleeve segment of FIG. 5.

A sleeve segment (1) according to a preferred embodiment of the present invention has the shape of a sleeve with a first circular side (4) containing a female registration element (6, 76) and a second circular side (5) containing a male registration element (7). An example of such a flexographic sleeve segment (1) having an inner surface (3) and a printing surface (2) is shown by FIG. 1 and FIG. 5.

In one preferred embodiment, the sleeve segment according to the present invention is a basic sleeve segment.

In another preferred embodiment, the sleeve segment is a flexographic printing sleeve segment.

Although it is possible to use different male and female registration elements on two different sleeve segments as long as the two different sleeve segments can be connected to each other, it is advantageous to use the same shape and size for the male and female registration elements on all the sleeve segments used for making a segmented sleeve.

In a preferred embodiment of the sleeve segment according to the present invention the male registration element fits the female registration element. Fitting of the male and female registration elements means that their size is approximately the same such that no large force is required to connect them. In a preferred embodiment, the male registration element is a bit smaller than the female registration element.

In another preferred embodiment, the sleeve segment according to the present invention includes a plurality of female and male registration elements. There are no real restrictions in the shape of the female and male registration elements as long as they can fit into each other. In a preferred embodiment a sleeve contains two female and two male registration elements, preferably with the female registration elements on one side of the sleeve segment and the male registration elements on the other side of the sleeve segment.

Figure 7:
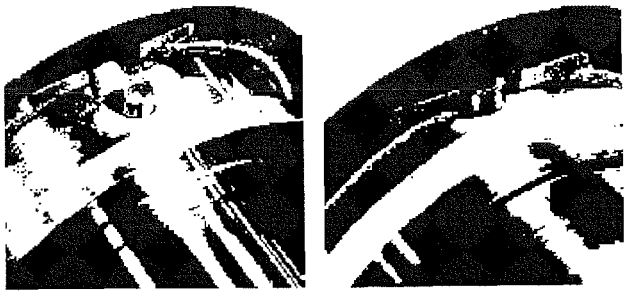
FIG. 7 is a photograph showing how the sleeve segment of FIG. 6 is glided over a radially projecting pin on a roll core.

In a preferred embodiment as shown by FIG. 5, the sleeve segment (1) having an inner surface (3) and a printing surface (2) has the shape of a sleeve with a first circular side (3) containing a female registration element (76) and a second circular side (5) containing a male registration element (7) wherein the female registration element (76) and the male registration element (7) differ in shape. The advantage of the L-shape of the female registration element (76) is that the female registration element (76) can first be glided over a radially projecting pin of a roll core in a first direction parallel with the axis of the roll core (see FIG. 7) and then "locked" by gliding it in a second direction perpendicular on the first direction. The male registration element (7) is smaller in size than the female registration element (76) but clearly still fits well on a second sleeve segment having the same L-shaped female registration element.

The flexographic printing sleeve segment is provided with a relief for printing an image on an ink-receiver. The relief can be made by any known imaging technique for making a flexographic printing form, including both analogue imaging techniques such as a UV exposure through a film mask, and digital imaging techniques which includes direct laser engraving, mask-less direct UV or violet exposure by laser or LED, UV exposure through a LAMS mask, and inkjet printing on flexographic printing form precursors.

In a preferred embodiment, the flexographic printing sleeve segment according to the present invention includes a relief made at least partially by laser exposure.

In an preferred embodiment, the flexographic sleeve segment according to the present invention includes a relief made at least partially by inkjet.

Segmented Sleeves

A segmented sleeve is a combination of two or more sleeve segments in such a way that they are connected to each other by a male registration element fitted into a female registration element. Such a combination is shown in FIG. 2 where a series of sleeve segments (21, 22, 23, 24) of different widths form a segmented sleeve (20) and a fifth sleeve segment (25) is to be added by connecting a male registration element (26) of the segmented sleeve (20) to a female registration element (27).

Figure 2:
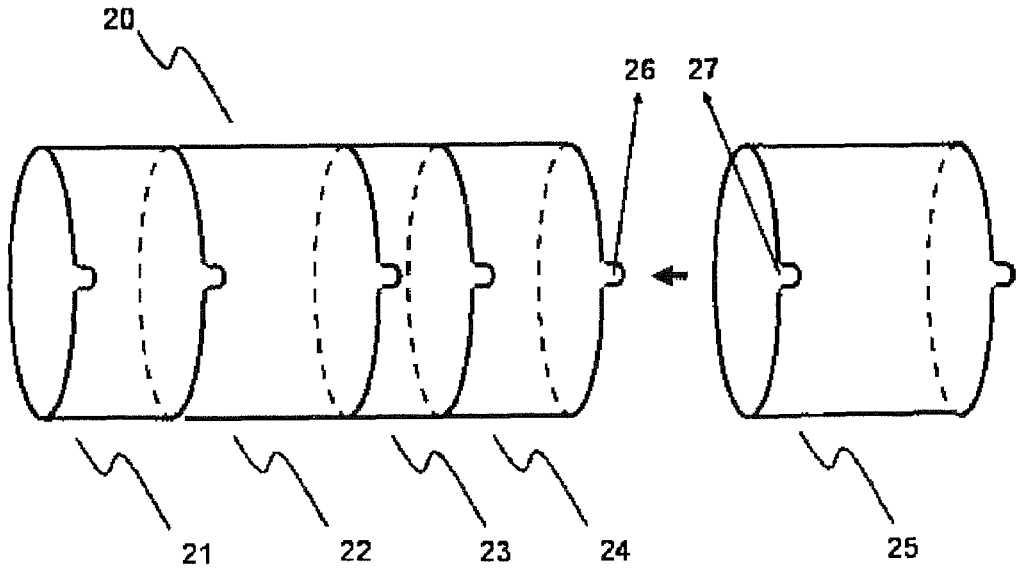
FIG. 2 shows a perspective view of a series of sleeve segments (21, 22, 23, 24) of different widths forming a segmented sleeve (20) and a fifth sleeve segment (25) to be added by connecting a female registration element (27) to a male registration element (26) of the segmented sleeve (20).

FIG. 2 illustrates the combination of a sleeve segment (22) having a large width with a sleeve segment (23) having a smaller width. Such a combination would be difficult to realize on a roll core as shown in FIG. 1 of EP 510744 A (MILLER GRAPHICS), where the roll core has a plurality of radially projecting pins on a regular distance from each other.

Figure 3:
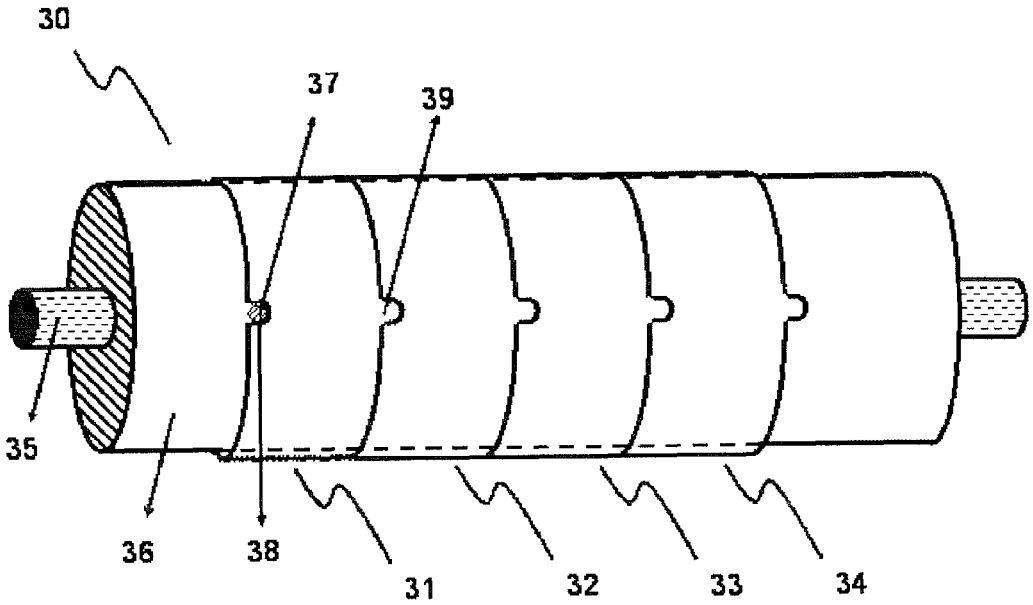
FIG. 3 shows a perspective view of a printing roll (30) having a segmented sleeve composed of four sleeve segments (31, 32, 33, 34) on a roll core (36) wherein a female registration element (38) of first sleeve (31) is registered on a radially projecting pin (37).

As shown in FIG. 3, such a segmented sleeve can then be mounted onto a roll core (36) having a driving shaft (35) by registering the first sleeve segment (31) with its female registration element (38) on the radially projecting pin (37). The male registration element (39) then serves for accurate registration of the second sleeve segment (32) using its female registration element. The same principle of connecting male and female registration elements applies for adding the third sleeve segment (33) and the fourth sleeve segment (34), thereby forming a printing roll (30).

Flexographic printing sleeves are often stored for future re-use. For example, in an original flexographic print job of labels A, B and C, a customer may request an additional number of labels A and C while label B has been slightly modified to B' which has a smaller width and a different image. In a preferred embodiment of the present invention, it is easy to re-use the original flexographic sleeve segments A and C in combination with a newly manufactured sleeve segment B'. In case that the label B', for example, has a much smaller width, the printer could opt to add another sleeve segment D in the print job for a different customer, thereby maximizing productivity.

In a preferred embodiment, the segmented sleeve according to the present invention includes at least one flexographic printing sleeve segment not yet used for flexographic printing and at least one flexographic sleeve segment already used for flexographic printing.

Figure 4:
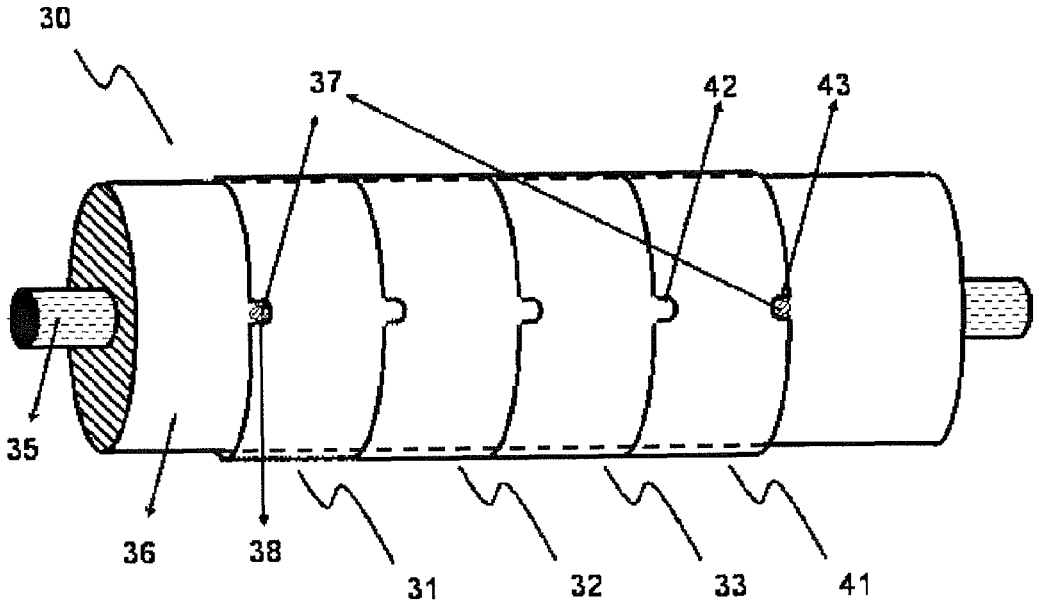
FIG. 4 shows a perspective view of a printing roll (30) having a segmented sleeve composed of four sleeve segments (31, 32, 33, 34) on a roll core (36) wherein a female registration element (38) of first sleeve (31) and a female registration element (43) of the last sleeve (41) are registered on radially projecting pins (37).

In another preferred embodiment, the last sleeve segment of a segmented sleeve may contain at least two female registration elements. This modification can be advantageously used to have all sleeve segments registered in a straight parallel to the axis of the roll core and also prevents movement of the sleeve segments on the roll core during prolonged printing times. This is exemplified in FIG. 4 where a segmented sleeve is mounted onto a roll core (36) having a driving shaft (35). The first sleeve segment (31) with its female registration element (38) is positioned on a radially projecting pin (37). The male registration element (39) then serves for accurate registration of the second sleeve segment (32) using its female registration element. The same principle of connecting male and female registration elements applies for adding the third sleeve segment (33) and the fourth sleeve segment (41). The fourth sleeve segment (41) is connected on one circular side with its female registration element (42) to the male registration element of third sleeve segment (33) and on the other circular side with a female registration element (43) on a radially projecting pin (37), thereby forming a printing roll (30).

The radially projecting pin can be mounted onto the roll core, e.g. by screwing it into a pre-drilled hole on the roll core, but is preferably a pin incorporated in the roll core which can be directed outwards from inside the roll core.

In a preferred embodiment, the segmented sleeve according to the present invention has at both ends a circular side containing a female registration element.

Methods of Flexographic Printing

A method of flexographic printing according to a preferred embodiment of the present invention comprises the steps of:

a) forming a segmented sleeve on a roll core (36) having at least a first sleeve segment (31) and a second sleeve segment (32) connected to each other by a male registration element on the first sleeve segment fitting into a female registration element of the second flexographic sleeve segment; and c) making a flexographic print with the segmented sleeve.

In one preferred embodiment of the method, the first sleeve segment is mounted on the roll core by registering its female registration element on a radially projecting pin (37) of the roll core (36) and then connecting it with the second sleeve segment by fitting the male registration element on the first sleeve segment into the female registration element of the second flexographic sleeve segment.

In another preferred embodiment, the second sleeve segment is already connected to the first sleeve segment before registering the female registration element on a radially projecting pin of the roll core. This can be done in several ways. For example, in a first way the first and second sleeve segment can be first connected to each other and then glided over the roll core to register the female registration element of the first sleeve segment on a radially projecting pin of the roll core. A second way is to slide the first sleeve segment partially over the roll core in such a manner that the male registration element extends freely in the air and is not positioned on the surface of the roll core, the second sleeve segment is then connected by its female registration element to the first sleeve segment. Contrary to the first way, the second way allows a robust male-female connection, similar to those present in a jigsaw puzzle, which have to be clicked into each other rather than glided into each other.

In one preferred embodiment of the method of flexographic printing according to the present invention, at least one flexographic sleeve segment has not yet been used for flexographic printing and at least one flexographic sleeve segment has already been used for flexographic printing.

In one preferred embodiment of the method of flexographic printing according to the present invention, the segmented sleeve has at both ends a circular side containing a female registration element registered on radially projecting pins of the roll core.

Basic Sleeves

The basic sleeve can be any material that is conventionally used to prepare flexographic printing masters. For good printing results, a dimensionally stable support is required. Basic sleeves, often also called a sleeve base, ordinarily consist of composites, such as epoxy or polyester resins reinforced with glass fibre or carbon fibre mesh. Metals, such as steel, aluminium, copper and nickel, and hard polyurethane surfaces (e.g. durometer 75 Shore D) can also be used.

The sleeve may be formed from a single layer or multiple layers of flexible material, as for example disclosed by US 2002/0466668 (ROSSINI). Flexible sleeves made of polymeric films can be transparent to ultraviolet radiation and thereby accommodate backflash exposure for building a floor in the cylindrical printing element. Multiple layered sleeves may include an adhesive layer or tape between the layers of flexible material. Preferred is a multiple layered sleeve as disclosed in U.S. Pat. No. 5,301,610 (DU PONT). The sleeve may also be made of non-transparent, actinic radiation blocking materials, such as nickel or glass epoxy.

Depending upon the type of tubing and the number of layers of mesh applied, the wall thickness of these sleeve bases varies. The sleeve typically has a wall thickness from 0.1 to 1.5 mm for thin sleeves and from 2 mm to as high as 100 mm for other sleeves.

For thick sleeves often combinations of a hard polyurethane surface with a low-density polyurethane foam as an intermediate layer combined with a fibreglass reinforced composite core are used as well as sleeves with a highly compressible surface present on a sleeve base.

Depending upon the specific application, sleeve bases may be conical or cylindrical. Cylindrical sleeve bases are used primarily in flexographic printing.

As press speeds have increased, press bounce has become a more frequent problem. Various approaches can be taken to reduce press bounce, including the use of cushioned sleeves. Sleeves come in different constructions, e.g. with a hard or a compressible core or surface, with varying wall thicknesses.

The basic sleeve or flexographic printing sleeve is stabilized by fitting it over a steel roll core known as an air mandrel or air cylinder. Air mandrels are hollow steel cores which can be pressurized with compressed air through a threaded inlet in the end plate wall. Small holes drilled in the cylindrical wall serve as air outlets. The introduction of air under high pressure permits it to float into position over an air cushion. Certain thin sleeves are also expanded slightly by the compressed air application, thereby facilitating the gliding movement of the sleeve over the roll core.

Foamed adapter or bridge sleeves are used to "bridge" the difference in diameter between the air-cylinder and a flexographic printing sleeve containing the printing relief. The diameter of a sleeve depends upon the required repeat length of the printing job.

Flexographic Printing Sleeves

A flexographic printing sleeve is a basic sleeve provided with one or more elastomeric layers. The elastomeric layers may be any material that is conventionally used to prepare flexographic printing masters. The elastomeric layers are preferably partially or fully cured photopolymer layers, but can also be rubber or polyurethane layers. It is also possible to use a partially or fully cured conventional UV exposure flexographic printing form precursor as flexographic printing sleeve. A wide variety of such conventional flexographic printing form precursors are commercially available.

A printing relief can be formed in several ways on the flexographic printing sleeve. In a preferred embodiment the relief is formed by inkjet printing on the one or more elastomeric layers already present as an "elastomeric floor". In the latter, the one or more elastomeric layers are preferably partially cured layers to enhance the adhesion of the relief jetted onto the elastomeric layers. Alternatively the elastomeric floor may also be applied to the surface of the basic sleeve by inkjet printing.

In another preferred embodiment, the elastomeric layers are fully cured and the relief is formed by laser engraving. In laser engraving, the elastomeric layers of a different hardness can be used to obtain the desired hardness.

In another preferred embodiment the flexographic printing sleeve is prepared by a coating method as disclosed in WO 2008/034810 (AGFA GRAPHICS).

Different types of printing applications require flexographic printing forms with differing degrees of hardness. Softer flexographic printing forms are more suited for rough substrates because they can better cover the highs and lows. The harder flexographic printing forms are used for even and smooth substrates. The optimum hardness of a flexographic printing form also depends on whether the image is solid or halftone. Softer flexographic printing forms will transfer the ink better in solid areas, though harder flexographic printing forms have less dot gain. The hardness is a measure of the printing form's mechanical properties which is measured in degree of Shore A. For example, printing on corrugated board requires usually a hardness of 35° Shore A, whereas for reel presses 65° to 75° Shore A is a standard.

Depending on the substrate to be printed upon, the hardness and thickness of the flexographic printing form have to be adjusted. Depending on the application, the relief depth varies from 0.2 to 4 mm, preferably from 0.4 to 2 mm.

Methods of Manufacturing Sleeve Segments

A method of manufacturing a sleeve segment according to a preferred embodiment of the present invention comprises the steps of:

a) providing a sleeve with a first circular side having at least one female registration element on the first circular side; and b) cutting a second circular side from the sleeve and providing it with at least one male registration element.

The cutting of the second circular side from the sleeve can be performed in several ways well-known to the skilled person. Cutting is preferably performed by so-called CNC (=Computer Numerically Controlled) cutting methods, e.g. laser cutting, plasma cutting and water jet cutting. Laser cutting may be performed by gaseous $CO_2$ and solid state Nd:YAG lasers.

Also mechanical cutting may be used, e.g. sawing. However mechanically cutting may in some cases prove to be difficult to cut out the registration element. In these cases the second circular side can e.g. be cut incompletely and the at least one male registration element can be punched out from the remaining uncut part.

In a preferred embodiment of the method, the cutting is performed by laser cutting, since it has the advantage that both the circular side and the registration elements can be performed in a single operation.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A sleeve segment for flexographic printing, the sleeve segment comprising:

a sleeve including a first circular side containing a female registration element and a second circular side containing a male registration element; wherein the sleeve includes only one or two female registration elements and no male registration elements on the first circular side of the sleeve, and only one or two male registration elements and no female registration elements on the second circular side of the sleeve.

2. The sleeve segment according to claim 1, wherein the sleeve segment is a basic sleeve segment without elastomeric layers on an outer surface of the sleeve segment.

3. The sleeve segment according to claim 1, wherein the sleeve segment is a flexographic printing sleeve segment including one or more elastomeric layers on an outer surface of the sleeve segment.

4. The sleeve segment according to claim 1, wherein a size and a shape of the male registration element matches a size and a shape of the female registration element.

5. The sleeve segment according to claim 1, wherein the sleeve segment includes a plurality of the female registration elements.

6. The sleeve segment according to claim 1, further comprising:

a laser or LED relief that is laser exposed or LED exposed.

7. The sleeve segment according to claim 1, further comprising:

an inkjet relief including at least an inkjet printed portion.

8. A segmented sleeve comprising:

two or more sleeve segments as defined by claim 1 connected to each other by a male registration element of a first sleeve segment being fitted into a female registration element of a second sleeve segment.

9. A printing roll comprising:

a roll core including only one radially projecting pin; and a segmented sleeve as defined by claim 8 mounted on the roll core; wherein a size and a shape of the female registration element matches a size and a shape of the radially projecting pin on the roll core.

10. A printing roll comprising:

a roll core including only one radially projecting pin; and a segmented sleeve as defined by claim 8 mounted on the roll core; wherein the female registration element has an L-shape which matches a size of the radially projecting pin on the roll core.

11. The sleeve segment according to claim 1, wherein the first circular side contains only one female registration element and the second circular side contains only one male registration element.

12. A method of flexographic printing comprising the steps of:

providing a roll core;

forming a segmented sleeve as defined by claim 8 on the roll core, the segmented sleeve including at least the first sleeve segment and the second sleeve segment connected to each other; and flexographic printing with the segmented sleeve.

13. The method according to claim 12, wherein the step of forming the segmented sleeve on the roll core includes the steps of:

registering a female registration element of the first sleeve segment element with a radially projecting pin on the roll core; and then connecting the second sleeve segment with the first sleeve segment by fitting the male registration element on the first sleeve segment into the female registration element of the second sleeve segment.

14. The method according to claim 12, wherein the step of forming the segmented sleeve on the roll core includes the steps of:

connecting the second sleeve segment to the first sleeve segment; and then registering a female registration element of the first sleeve segment with a radially projecting pin of the roll core.

15. A method of manufacturing a sleeve segment as defined by claim 1, the method comprising the steps of:

providing the sleeve with the only one or two female registration elements on the first circular side of the sleeve;

cutting the second circular side into the sleeve; and providing the second circular side with the only one or two male registration elements.

16. The method according to claim 15, wherein the step of cutting is performed by laser cutting.

* * * * *